US009530357B2

(12) United States Patent
Kim et al.

(10) Patent No.: US 9,530,357 B2
(45) Date of Patent: Dec. 27, 2016

(54) GRADATION VOLTAGE GENERATOR AND DISPLAY DRIVING APPARATUS

(71) Applicant: SAMSUNG ELECTRONICS CO., LTD., Suwon-Si, Gyeonggi-Do (KR)

(72) Inventors: In-Suk Kim, Suwon-Si (KR); Byung-Hun Han, Eunpyeong-Gu (KR); Jae-Hyuck Woo, Osan-Si (KR)

(73) Assignee: SAMSUNG ELECTRONICS CO., LTD., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 14/835,128

(22) Filed: Aug. 25, 2015

(65) Prior Publication Data

US 2015/0364093 A1 Dec. 17, 2015

Related U.S. Application Data

(63) Continuation of application No. 13/765,752, filed on Feb. 13, 2013, now Pat. No. 9,135,853.

(30) Foreign Application Priority Data

Apr. 13, 2012 (KR) ..... 10-2012-0038709

(51) Int. Cl.
*G09G 1/00* (2006.01)
*G09G 3/32* (2016.01)

(52) U.S. Cl.
CPC ..... *G09G 3/3291* (2013.01); *G09G 3/3208* (2013.01); *G09G 3/3225* (2013.01);
(Continued)

(58) Field of Classification Search
CPC ..... G09G 1/00; G09G 2320/0673; G09G 2320/0276; G09G 2310/027; G09G 3/3696; G09G 3/3688; G09G 2310/08; G06F 1/00
See application file for complete search history.

(56) References Cited

U.S. PATENT DOCUMENTS 6,157,356 A 12/2000 Troutman
7,079,092 B2 7/2006 Tanghe et al.
(Continued)

FOREIGN PATENT DOCUMENTS

JP 07-013525 1/1995
JP 2002-250908 9/2002
(Continued)

*Primary Examiner* — Michael Faragalla
(74) *Attorney, Agent, or Firm* — F. Chau & Associates, LLC

(57) ABSTRACT

A gradation voltage generator for applying a gradation voltage according to gamma characteristics of a display panel includes a reference gamma selector that receives a maximum reference voltage, a minimum reference voltage, and a first reference voltage, and selects and outputs a maximum gamma voltage and a minimum gamma voltage from among voltages between the maximum reference voltage and the minimum reference voltage, wherein when the maximum reference voltage changes, the minimum gamma voltage is compensated by a difference the changed maximum reference voltage and the first reference voltage and a gamma curve controller that receives the maximum gamma voltage and the minimum gamma voltage, and generates and outputs a plurality of gradation voltages.

18 Claims, 11 Drawing Sheets

(52) U.S. Cl.
CPC . *G09G 2310/027* (2013.01); *G09G 2320/043* (2013.01); *G09G 2320/0673* (2013.01); *G09G 2330/028* (2013.01)

(56) References Cited

U.S. PATENT DOCUMENTS

| | | | | |
|---|---|---|---|---|
| 7,151,550 | B2 | 12/2006 | Lau et al. | |
| 7,307,610 | B2 | 12/2007 | Sakaguchi | |
| 7,880,692 | B2 | 2/2011 | Wang | |
| 2007/0008347 | A1 | 1/2007 | Choi | |
| 2008/0024526 | A1 | 1/2008 | Ko et al. | |
| 2008/0165109 | A1 | 7/2008 | Joo et al. | |
| 2009/0243989 | A1 | 10/2009 | Lee et al. | |
| 2010/0033514 | A1 | 2/2010 | Park et al. | |
| 2010/0265274 | A1 | 10/2010 | Han et al. | |
| 2011/0157152 | A1* | 6/2011 | Byun ..... | G09G 3/3233 345/214 |
| 2011/0227905 | A1 | 9/2011 | Enjou | |

FOREIGN PATENT DOCUMENTS

| | | | |
|---|---|---|---|
| JP | 2010-139795 | | 6/2010 |
| JP | 2010-281872 | | 12/2010 |
| JP | 2011-154106 | | 8/2011 |
| KR | 10-2005-0067246 | A | 7/2005 |
| KR | 10-0796155 | B1 | 1/2008 |
| KR | 1020080057931 | | 6/2008 |
| KR | 10-0860718 | B1 | 9/2008 |
| KR | 10-2008-0105714 | A | 12/2008 |

* cited by examiner

GRADATION VOLTAGE GENERATOR AND DISPLAY DRIVING APPARATUS

CROSS-REFERENCE TO RELATED APPLICATIONS

This application is a continuation of U.S. application Ser. No. 13/765,752 filed on Feb. 13, 2013, which claims priority to Korean Patent Application No. 10-2012-0038709 filed in the Korean Intellectual Property Office on Apr. 13, 2012, the disclosure of which is incorporated by reference herein in its entirety.

BACKGROUND

Embodiments of the inventive concept relate to a gradation voltage generator and a display driving apparatus, and more particularly to a gradation voltage generator for preventing image quality from being degraded even when a driving voltage for a display panel changes and a display driving apparatus including the gradation voltage generator.

A display panel has unique gamma characteristics. A gradation voltage generator generates gradation voltages that reflect the gamma characteristics of the display panel and applies the gradation voltages to a data driver. The data driver selects gradation voltages corresponding to digital data from among the gradation voltages and applies the selected gradation voltages to pixels of the display panel. The brightness of light emitted from the display panel may be determined by a relative value of a panel driving voltage, which is commonly applied to all the pixels of the display panel, and a gradation voltage.

SUMMARY

Embodiments of the inventive concept provide a gradation voltage generator for generating a gradation voltage compensated according to a change in a power supply voltage of a display panel, and a display driving apparatus including the same.

According to an embodiment of the inventive concept, there is provided a gradation voltage generator for applying a gradation voltage according to gamma characteristics of a display panel, the gradation voltage generator including a reference gamma selector for receiving a maximum reference voltage, a minimum reference voltage, and a first reference voltage whose level is equal or substantially equal to a predetermined level of the maximum reference voltage, and selecting and outputting a maximum gamma voltage and a minimum gamma voltage from among voltages between the maximum reference voltage and the minimum reference voltage, wherein the minimum gamma voltage is compensated according to a difference between the first reference voltage and the maximum reference voltage, and a gamma curve controller for receiving the maximum gamma voltage and the minimum gamma voltage, and generating and outputting a plurality of gradation voltages.

The maximum reference voltage may vary according to a change in a panel driving voltage of the display panel, and the minimum gamma voltage may be changed by at least a change in the maximum reference voltage.

The reference gamma selector may include a maximum-minimum selection unit for selecting the maximum gamma voltage corresponding to a maximum selection signal and a first minimum gamma voltage corresponding to a minimum selection signal from among the voltages between the maximum reference voltage and the minimum reference voltage, a voltage compensation unit for outputting a second minimum gamma voltage compensated based on the first reference voltage and the maximum reference voltage, and a compensation selection unit for selecting one of the first minimum gamma voltage and the second minimum gamma voltage, as the minimum gamma voltage, according to a compensation selection signal.

The voltage compensation unit may generate the second minimum gamma voltage by receiving the first reference voltage, the maximum reference voltage, and the first minimum gamma voltage, by calculating the difference between the maximum reference voltage and the first reference voltage, and by adding the difference to the first minimum gamma voltage.

The voltage compensation unit may include an amplifier having a first input terminal, a second input terminal, and an output terminal, wherein the amplifier is configured to output the second minimum gamma voltage via the output terminal, a first resistor having one end to which the first reference voltage is applied and another end connected to the first input terminal of the amplifier, a second resistor having one end connected to the first input terminal of the amplifier and another end connected to the output terminal of the amplifier, a third resistor having one end to which maximum reference voltage is applied and another end connected to the second input terminal of the amplifier, and a fourth resistor having one end to which the first minimum gamma voltage is applied and another end connected to the second input terminal of the amplifier.

The gradation voltage generator may further include an initial minimum selection unit for outputting a voltage corresponding to the minimum selection signal from among voltages between the first reference voltage and the minimum reference voltage, as an initial minimum gamma voltage.

The voltage compensation unit may generate the second minimum gamma voltage by receiving the first reference voltage, the maximum reference voltage, and the initial minimum gamma voltage, by calculating the difference between the maximum reference voltage and the first reference voltage, and by adding the difference to the initial minimum gamma voltage.

The reference gamma selector may include a voltage compensation unit for outputting a compensated minimum reference voltage that is equal to a sum of the minimum reference voltage and the difference between the maximum reference voltage and the first reference voltage, a compensation selection unit for selecting and outputting one of the minimum reference voltage and the compensated minimum reference voltage, according to a compensation selection signal, and a maximum-minimum selection unit for selecting the maximum gamma voltage corresponding to a maximum selection signal and the minimum gamma voltage corresponding to a minimum selection signal from among voltages between the maximum reference voltage and the selected voltage received from the compensation selection unit.

The voltage compensation unit may generate the compensated minimum reference voltage by receiving the first reference voltage, the maximum reference voltage, and the minimum reference voltage, by calculating the difference between the maximum reference voltage and the first reference voltage, and by adding the difference to the minimum reference voltage.

According to an embodiment of the inventive concept, there is provided a display driving apparatus for driving a display panel, the display driving apparatus including a voltage generator for generating and outputting a first reference voltage and a maximum reference voltage, and a gradation voltage generator for receiving the maximum reference voltage, a minimum reference voltage, and the first reference voltage whose level is equal or substantially equal to a predetermined level of the maximum reference voltage, generating a maximum gamma voltage and a minimum gamma voltage, generating a plurality of gradation voltages from the maximum gamma voltage and the minimum gamma voltage, and then outputting the plurality of gradation voltages, wherein the minimum gamma voltage is compensated according to a difference between the maximum reference voltage and the first reference voltage.

The gradation voltage generator may include a reference gamma selector for selecting and outputting the maximum gamma voltage according to a maximum selection signal, and selecting and outputting the minimum gamma voltage according to a minimum selection signal and a compensated selection signal, from among voltages between the maximum reference voltage and the minimum reference voltage, and a gamma curve controller for selecting a plurality of gamma voltages from among voltages between the maximum gamma voltage and the minimum gamma voltage, and generating and outputting plurality of gradation voltages by dividing voltages between the plurality of gamma voltages.

When an offset occurs in a panel driving voltage, the voltage generator may output the maximum reference voltage, wherein the difference between the maximum reference voltage and the first reference voltage is equal or substantially equal to the offset.

The voltage generator may include a first voltage generator for generating the first reference voltage from a power supply voltage, wherein the first reference voltage is constant regardless of a change in a panel driving voltage, a second voltage generator for receiving the panel driving voltage and generating a second reference voltage from the panel driving voltage, wherein the second reference voltage changes according to an offset in the panel driving voltage, and a maximum reference voltage selection unit for selecting and outputting one of the first reference voltage and the second reference voltage as the maximum reference voltage.

The maximum reference voltage selection unit may select the first reference voltage as the maximum reference voltage when voltage setting is performed, and selects the second reference voltage as the maximum reference voltage when the display panel is driven.

At least one of pixels of the display panel may include an organic light emitting diode.

According to an embodiment, there is provided a gradation voltage generator including a first unit configured to generate a first gamma voltage and a second gamma voltage higher than the first gamma voltage from a first reference voltage and a second reference voltage higher than the first reference voltage, wherein the first reference voltage is generated based on a panel driving voltage, and wherein the first reference voltage is closer to the first gamma voltage than to the second gamma voltage, a second unit configured to compensate for the second gamma voltage when the first reference voltage is changed to generate a third gamma voltage, and a third unit configured to output the plurality of gradation voltages from the first gamma voltage and the second gamma voltage or from the first gamma voltage and the third gamma voltage to a display panel.

The gradation voltage generator further includes a multiplexer configured to selecting one of the second gamma voltage and the third gamma voltage in response to a compensation selection signal.

The compensation selection signal is set depending on a change in the panel driving voltage.

When the change in the panel driving voltage has a predetermined level, the multiplexer is configured to select the third gamma voltage.

The third gamma voltage is the same or substantially the same as a sum of the second gamma voltage and a change in the first reference voltage.

BRIEF DESCRIPTION OF THE DRAWINGS

Exemplary embodiments of the inventive concept will be more clearly understood from the following detailed description taken in conjunction with the accompanying drawings in which.

DETAILED DESCRIPTION OF THE EMBODIMENTS

Figure 1:
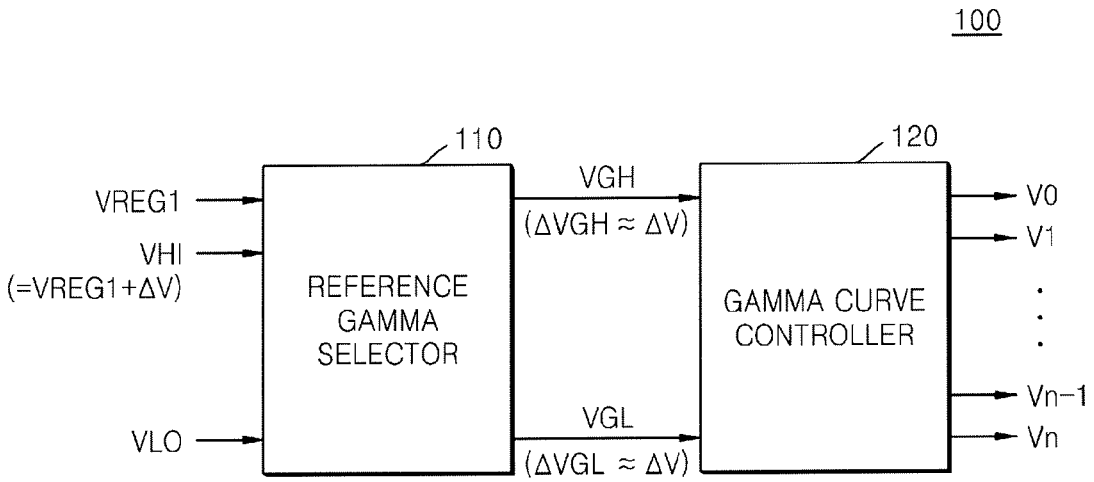
FIG. 1 is a block diagram illustrating a gradation voltage generator according to an embodiment of the inventive concept.

Hereinafter, the inventive concept will be described more fully with reference to the accompanying drawings, in which exemplary embodiments are shown. In the drawings, like reference numerals may denote like or similar elements throughout the specification and the drawings, and the lengths and sizes of layers and regions may be exaggerated for clarity.

As used herein, the singular forms 'a', 'an', and 'the' are intended to include the plural forms as well, unless the context clearly indicates otherwise.

FIG. 1 is a block diagram illustrating a gradation voltage generator 100 according to an embodiment of the inventive concept. Referring to FIG. 1, the gradation voltage generator 100 includes a reference gamma selector 110 and a gamma curve controller 120.

The reference gamma selector 110 receives a maximum reference voltage VHI, a first reference voltage VREG1, and a minimum reference voltage VLO, generates a maximum gamma voltage VGH and a minimum gamma voltage VGL, and then applies the maximum gamma voltage VGH and the minimum gamma voltage VGL to the gamma curve controller 120. The gamma curve controller 120 generates and outputs a plurality of gradation voltages V0 to Vn based on the maximum gamma voltage VGH and the minimum gamma voltage VGL. For example, according to an embodiment, the gamma curve controller 120 may divide the maximum gamma voltage VGH and the minimum gamma voltage VGL into a plurality of voltages by using a resistor string and may select some of the plurality of voltages as gradation voltages V0 to Vn.

Figure 2:
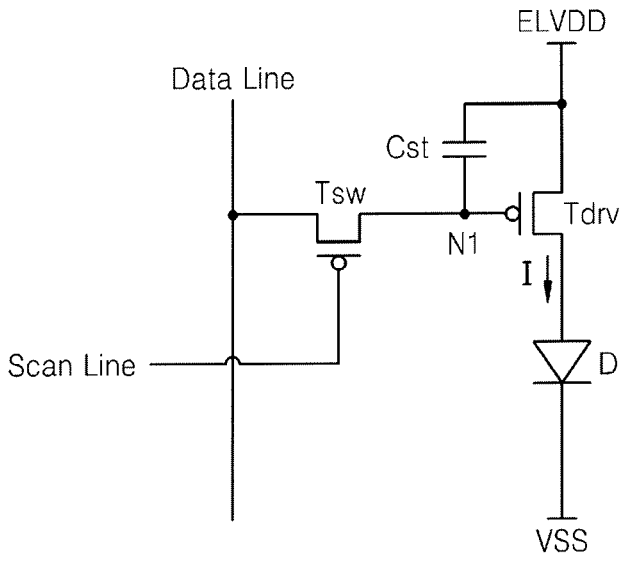
FIG. 2 is a circuit diagram illustrating a pixel of an organic electroluminescent display apparatus according to an embodiment of the inventive concept.

The maximum reference voltage VHI may be generated based on a panel driving voltage ELVDD as shown in FIG. 2. Thus, the maximum reference voltage VHI may vary according to a change in the panel driving voltage ELVDD, which is caused by an offset or ripples occurring in the panel driving voltage ELVDD. According to an embodiment, a value of the first reference voltage VREG1 may be equal to an original value of the maximum reference voltage VHI. According to an embodiment, the original value of the maximum reference voltage VHI refers to a value of the maximum reference voltage VHI before the maximum reference voltage VHI is changed. According to an embodiment, the minimum reference voltage VLO may be a ground voltage.

The reference gamma selector 110 selects the maximum gamma voltage VGH and the minimum gamma voltage VGL from among the maximum reference voltage VHI and voltages between the maximum reference voltage VHI and the minimum reference voltage VLO and outputs the selected maximum gamma voltage VGH and the minimum gamma voltage VGL to the gamma curve controller 120. The maximum gamma voltage VGH is relatively close to the maximum reference voltage VHI. As the maximum reference voltage VHI changes, the maximum gamma voltage VGH changes as well. The minimum gamma voltage VGL is relatively close to the minimum reference voltage VLO, and the minimum gamma voltage VGL may not be changed by a change in the maximum reference voltage VHI. The minimum gamma voltage VGL may be changed less than the maximum reference voltage VHI. The maximum gamma voltage VGH and the minimum gamma voltage VGL may be changed according to a change in the maximum reference voltage VHI by outputting the minimum gamma voltage VGL compensated according to the difference between the maximum reference voltage VHI and the first reference voltage VREG1, e.g., a change in the maximum reference voltage VHI.

The gamma curve controller 120 may select an intermediate gamma voltage from among the plurality of voltages divided from the maximum gamma voltage VGH and the minimum gamma voltage VGL, and may generate gradation voltages by dividing gamma voltages between the maximum gamma voltage VGH and the minimum gamma voltage VGL.

The maximum gamma voltage VGH and the minimum gamma voltage VGL output from the reference gamma selector 110 vary according to a change in the maximum reference voltage VHI. The gradation voltages V0 to Vn are generated based on the maximum gamma voltage VGH and the minimum gamma voltage VGL. Thus, the gradation voltages V0 to Vn change according to a change in the maximum reference voltage VHI. Thus, the gradation voltage generator 100 according to an embodiment may provide the gradation voltages V0 to Vn that vary according to a change in the maximum reference voltage VHI.

FIG. 2 is a circuit diagram illustrating a pixel of a display panel. For example, FIG. 2 illustrates a pixel of an organic light emitting display apparatus. Referring to FIG. 2, the pixel includes a switching transistor Tsw, a driving transistor Tdrv, a capacitor Cst, and an organic light emitting diode D.

The switching transistor Tsw includes a source connected to a data line, a drain connected to a first node N1, and a gate connected to a scan line. When the switching transistor Tsw is turned on, the switching transistor Tsw supplies a data signal to the driving transistor Tdrv. According to an embodiment, the data signal may be an analog signal, e.g., a gradation voltage corresponding to digital data.

The driving transistor Tdrv includes a source connected to a panel driving voltage ELVDD source, a drain connected to an anode electrode of the organic light emitting diode D, and a gate connected to the first node N1. The driving transistor Tdrv controls the amount of current I according to a panel driving voltage ELVDD and a voltage of the first node N1.

The capacitor Cst includes a first electrode connected to the panel driving voltage ELVDD source and a second electrode connected to the first node N1 and stores a voltage corresponding to a difference between the panel driving voltage ELVDD and a voltage of the data signal.

The organic light emitting diode D includes the anode electrode connected to the drain of the driving transistor Tdrv, a cathode electrode connected to a ground voltage VSS source, and a plurality of emission layers that emit light according to the flow of the current I. In the organic light emitting diode D, the current I flows from the cathode electrode to the anode electrode, and light is emitted from the plurality of emission layers according to the current I.

When an activation signal is supplied to the switching transistor Tsw via the scan line, the switching transistor Tsw is turned on. The turned-on switching transistor Tsw delivers a data signal received via the data line to the first node N1. The data signal delivered to the first node N1 is supplied to the gate of the driving transistor Tdrv. When the data signal is supplied to the gate of the driving transistor Tdrv, the current I flows through the driving transistor Tdrv. The amount of the current I may be expressed as follows:

$$I=\beta/2(Vgs-|Vth|)^2, \quad \text{[Equation 1]}$$

where 'I' denotes current flowing from the source of the driving transistor Tdrv toward the drain of the driving transistor Tdrv, 'Vgs' denotes a voltage between the gate and source of the driving transistor Tdrv, 'Vth' denotes a threshold voltage of the driving transistor Tdrv, and 'β' denotes a coefficient.

When the threshold voltage of the driving transistor Tdrv is constant, the amount of the current I is determined by a difference in voltage between the gate and source of the driving transistor Tdrv. For example, the amount of the current I flowing through the organic light emitting diode D is determined by the panel driving voltage ELVDD and the data signal. Thus, when the panel driving voltage ELVDD is changed due to an offset deviation or ripples, the difference in voltage between the source and gate of the driving transistor Tdrv is changed, thus changing the amount of the current I flowing through the organic light emitting diode D. Since the brightness of light emitted from the emission layers is determined by the current I flowing through the organic light emitting diode D, a change in the panel driving voltage ELVDD results in a change in the brightness of light, thereby degrading image quality.

However, as described above with reference to FIG. 1, the gradation voltage generator 100 of FIG. 1 according to an embodiment of the inventive concept generates the gradation voltages V0 to Vn that change according to a change in the maximum reference voltage VHI by using the maximum reference voltage VGH and the minimum gamma voltage VGL that change according to a change in the maximum reference voltage VHI. Since the maximum reference voltage VHI changes according to a change in the driving voltage ELVDD, a change in the driving voltage ELVDD also results in a change in the gradation voltages V0 to Vn. Thus, even when the driving voltage ELVDD changes, the difference in voltage between the source and gate of driving transistor Tdrv does not change and the amount of current I flowing through the organic light emitting diode D may remain constant. Accordingly, image quality may be prevented from being degraded.

Figure 3:
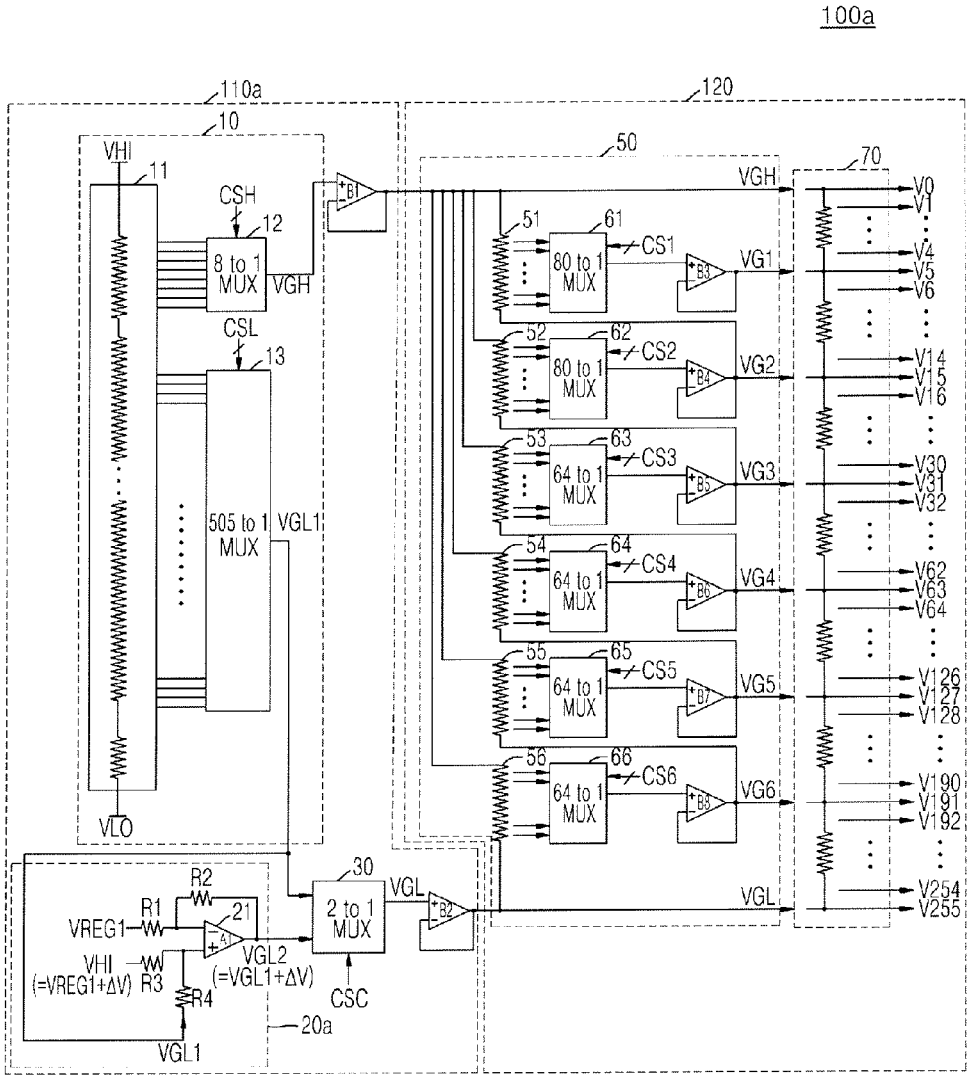
FIG. 3 is a circuit diagram illustrating an example of the gradation voltage generator of FIG. 1.

FIG. 3 is a circuit diagram illustrating a gradation voltage generator 100*a* that is an example of the gradation voltage generator 100 of FIG. 1. Referring to FIG. 3, the gradation voltage generator 100*a* includes a reference gamma selector 110*a* and a gamma curve controller 120. The reference gamma selector 110*a* generates a maximum gamma voltage VGH and a minimum gamma voltage VGL and applies the maximum gamma voltage VGH and the minimum gamma voltage VGL to the gamma curve controller 120, and the gamma curve controller 120 generates gradation voltages V0 to V255. Although FIG. 3 illustrates that the gamma curve controller 120 generates 256 gradation voltages V0 to V255, the inventive concept is not limited thereto. For example, according to an embodiment, the number of gradation voltages may vary according to the number of colors that are to be expressed by a display apparatus or the number of bits of digital data supplied to a data driver 300 of FIG. 9.

The reference gamma selector 110*a* includes a maximum-minimum selection unit 10, a voltage compensation unit 20*a*, and a compensation selection unit 30. According to an embodiment, the reference gamma selector 110*a* may further include buffers B1 and B2 for buffering and outputting the maximum gamma voltage VGH and the minimum gamma voltage VGL, respectively.

The maximum-minimum selection unit 10 includes a resistor string 11, the first selector 12, and the second selector 13. The maximum-minimum selection unit 10 selects a maximum gamma voltage VGH corresponding to a maximum selection signal CSH and a first minimum gamma voltage VGL1 corresponding to a minimum selection signal CSL from among voltages between the maximum reference voltage VHI and the minimum reference voltage VLO and outputs the maximum gamma voltage VGH and the first minimum gamma voltage VGL1.

The resistor string 11 includes a plurality of resistors connected in series. The maximum reference voltage VHI and the minimum reference voltage VLO are applied to two ends of the resistor string 11, and a plurality of voltages are generated at contact points of the plurality of resistors included in the resistor string 11.

The first selector 12 receives a plurality of voltages that are relatively close to the maximum reference voltage VHI from the resistor string 11, and selects and outputs the maximum gamma voltage VGH according to the maximum selection signal CSH. The second selector 13 receives a plurality of voltages that are relatively close to the minimum reference voltage VLO from the resistor string 11, and selects and outputs the first minimum gamma voltage VGL1 according to a minimum selection signal CSL.

According to an embodiment, the first selector 12 is embodied as a multiplexer for selecting one of eight input values, and the second selector 13 is embodied as a multiplexer for selecting one of 505 input values, but are not limited thereto. According to an embodiment, the first selector 12 and the second selector 13 may be any of various types of multiplexers or switches.

The voltage compensation unit 20*a* includes an amplifier A1 and four resistors R1 to R4. The voltage compensation unit 20*a* receives the maximum reference voltage VHI, a first reference voltage VREG1, and the first minimum gamma voltage VGL1, and generates a second minimum gamma voltage VGL2. The second minimum gamma voltage VGL2 is equal to the sum of the first minimum gamma voltage VGL1 and a difference between the maximum reference voltage VHI and the first reference voltage VREG1.

The first reference voltage VREG1 is connected to one end of the first resistor R1 and a first input terminal (−) of the amplifier A1 is connected to another end of the first resistor R1. The first input terminal (−) of the amplifier A1 is connected to one end of the second resistor R2 and an output terminal of the amplifier A1 is connected to another end of the second resistor R2. The maximum reference voltage VHI is applied to one end of the third resistor R3 and a second input terminal (+) of the amplifier A1 is connected to another end of the third resistor R3. The first minimum gamma voltage VGL1 is applied to one end of the fourth resistor R4 and the second input terminal (+) of the amplifier A1 is connected to another end of the fourth resistor R4. According to an embodiment, the first to fourth resistors R1 to R4 may have the same resistance value. According to an embodiment, the voltage compensation unit 20*a* functions as an adder or a subtractor according to a state in which the amplifier A1 and the resistors R1 to R4 are connected to one another. For example, according to an embodiment, the voltage compensation unit 20*a* outputs the second minimum gamma voltage VGL2 that is equal to the sum of the first minimum gamma voltage VGL1 and the difference between the maximum reference voltage VHI and the first reference voltage VREG1. According to an embodiment, since the first reference voltage VREG1 is equal to the original maximum reference voltage VHI, the difference between the maximum reference voltage VHI and the first reference voltage VREG1 may be substantially equal to a change in the maximum reference voltage VHI. Thus, the second minimum gamma voltage VGL2 may be equal to a result obtained by changing the first minimum gamma voltage VGL1 by the change in the maximum gamma voltage VHI.

The compensation selection unit 30 selects and outputs one of the first minimum gamma voltage VGL1 and the second minimum gamma voltage VGL2 as the minimum gamma voltage VGL according to a compensation selection signal CSC. According to an embodiment, the compensation selection signal CSC may be set outside the gradation voltage generator 100*a* or may be set inside the gradation voltage generator 100*a* by sensing a change in the panel driving voltage ELVDD. In other words, the compensation selection signal CSC may be determined by an outside source of the gradation voltage generator 100*a* or may be determined by the gradation voltage generator 100*a* based on a change in the panel driving voltage ELVDD. According to an embodiment, when the panel driving voltage ELVDD changes by a predetermined value or more, for example, to a degree to which image quality may be degraded, the compensation selection signal CSC may select a second minimum gamma voltage VGL2, e.g., a compensated minimum gamma voltage. Alternatively, the compensation selection signal CSC may select a first minimum reference voltage VGL1 when voltage setting is performed, such as, e.g., when the first minimum reference voltage VGL1 is initially set, and may select a second minimum reference voltage VGL2 when panel driving is performed, but the inventive concept is not limited thereto.

The maximum gamma voltage VGH and the first minimum gamma voltage VGL1 are selected from among voltages divided by the resistor string 11 between the maximum reference voltage VHI and the minimum reference voltage VLO. Thus, when the maximum reference voltage VHI changes, the maximum gamma voltage VGH and the minimum gamma voltage VGL1 change accordingly. For example, according to an embodiment, in the case that the maximum reference voltage VHI is 5V, the minimum reference voltage VLO is 0V, the maximum gamma voltage VGH is 4.5V, and the first minimum gamma voltage VGL1 is 1V, the maximum gamma voltage VGH increases by 90 mV to 4.59 V, and the first minimum gamma voltage VGL increases by 20 mV to 1.02V when the maximum reference voltage VHI increases by 100 mV to 5.1V. A degree of a change in the minimum gamma voltage VGL is less than a degree of a change in the maximum reference voltage VHI. The compensated minimum gamma voltage VGL2 is equal or substantially equal to the sum of the first minimum gamma voltage VGL1 and the increase in the maximum reference voltage VHI. For example, the compensated minimum gamma voltage VGL2 is about 1.12V. The degree of the change in the maximum reference voltage VHI may be closer to the degree of the change in the second minimum gamma voltage VGL2 than to the degree of the change in the first minimum gamma voltage VGL1. Thus, the second minimum gamma voltage VGL2 may be selected and output as the minimum gamma voltage VGL.

The gamma curve controller 120 includes an intermediate gamma selection unit 50 and a gradation output unit 70.

The intermediate gamma selection unit 50 includes a plurality of resistor strings 51 to 56 and a plurality of selectors 61 to 66. The intermediate gamma selection unit 50 selects and outputs intermediate gamma voltages VG1 to VG6 from among voltages divided by the plurality of resistor strings 51 to 56 according to gamma selection signals CS1 to CS6, respectively. The intermediate gamma selection unit 50 may further include buffers B3 to B8 for respectively buffering and outputting the intermediate gamma voltages VG1 to VG6. Although FIG. 3 illustrates that the six intermediate gamma voltages VG1 to VG6 are selected, the inventive concept is not limited thereto. The intermediate gamma voltages VG1 to VG6 are inflection points at which an inclination of a gamma curve changes. In other words, the intermediate gamma voltages VG1 to VG6 are reference levels at which a degree of change in a voltage of a unit gradation is changed. Thus, the number of gamma voltages may be determined in consideration of display characteristics.

The gradation output unit 70 generates a plurality of gradation voltages V0 to V255 by dividing the maximum gamma voltage VGH, the intermediate gamma voltages VG1 to VG6, and the minimum gamma voltage VGL by using a resistor string. For example, according to an embodiment, the maximum gamma voltage VGH may be the first gradation voltage V0 and the minimum gamma voltage VGL may be the $255^{th}$ gradation voltage V255.

Since the gamma curve controller 120 selects and outputs the 256 gradation voltages V0 to V255 from the divided voltages between the maximum gamma voltage VGH and the minimum gamma voltage VGL, the gradation voltages V0 to V255 change when the maximum gamma voltage VGH and the minimum gamma voltage VGL change according to a change in the maximum reference voltage VGH.

Figure 4:
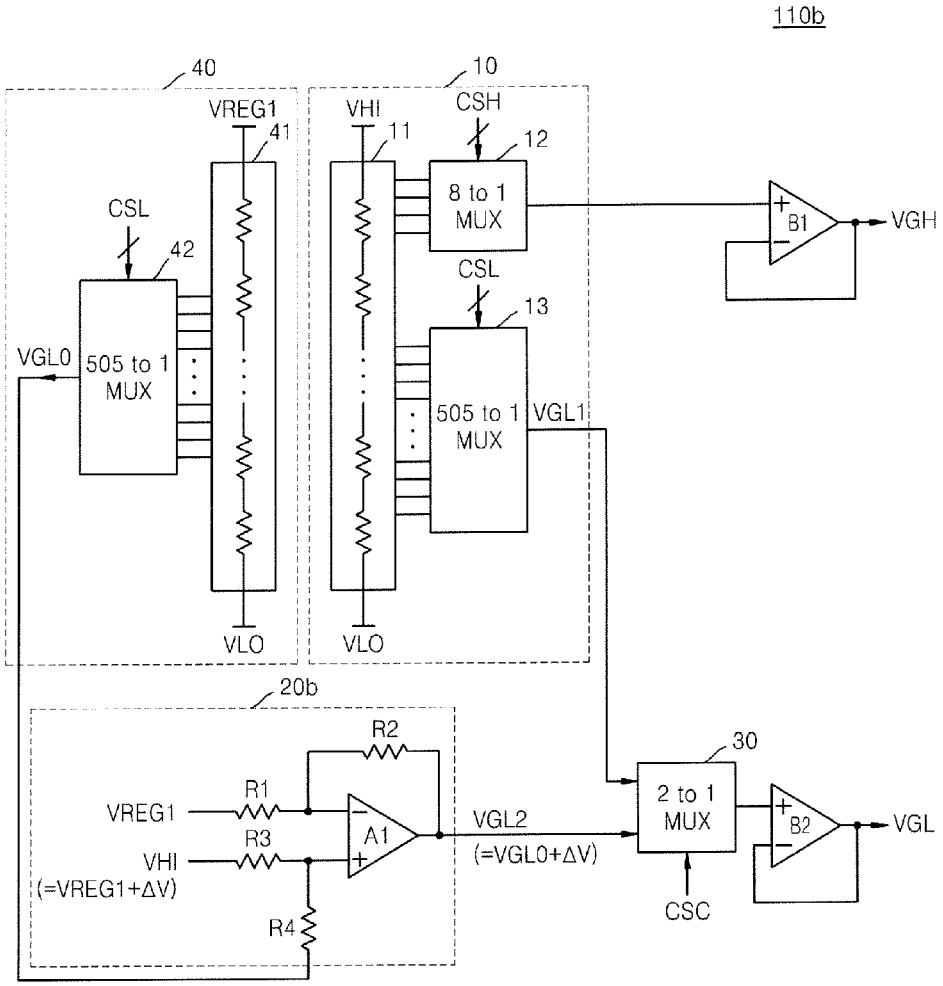
FIG. 4 is a circuit diagram illustrating an example of the reference gamma selector of FIG. 1.

FIG. 4 is a circuit diagram of a reference gamma selector 110*b* that is an example of the reference gamma selector 110 of FIG. 1. Referring to FIG. 4, the reference gamma selector 110*b* includes a maximum-minimum selection unit 10, a voltage compensation unit 20*b*, a compensation selection unit 30, and an initial minimum selection unit 40. According to an embodiment, the reference gamma selector 110*b* may further include buffers B1 and B2 for respectively buffering and outputting a maximum gamma voltage VGH and a minimum gamma voltage VGL.

The maximum-minimum selection unit 10 is the same or substantially the same as the maximum-minimum selection unit described above with reference to FIG. 3.

The initial minimum selection unit 40 includes a resistor string 41 including a plurality of resistors connected in series and a third selector 42. The initial minimum selection unit 40 outputs an initial minimum gamma voltage VGL0 corresponding to a minimum selection signal CSL from among voltages between a first reference voltage VREG1 and a minimum reference voltage VLO.

A first reference voltage VREG1 and a minimum reference voltage VLO are applied to two ends of the resistor string 41, and a plurality of voltages are generated at contact points of the plurality of resistors included in the resistor string 41.

The third selector 42 receives the plurality of voltages from the resistor string 41 and selects and outputs the initial minimum gamma voltage VGL0 according to a minimum selection signal CSL.

The resistor string 41 included in the initial minimum selection unit 40 may be substantially the same as the resistor string 11 included in the maximum-minimum selection unit 10 except for voltages applied to two ends thereof. According to an embodiment, the resistor string 41 and the third selector 42 are connected to each other in the same or substantially the same manner as the manner in which the resistor string 11 and the second selector 13 included in the maximum-minimum selection unit 10 are connected to each other. According to an embodiment, when the maximum reference voltage VHI has an original value, e.g. when the maximum reference voltage VHI is equal to the first reference voltage VREG1, a first minimum gamma voltage VGL1 and the initial minimum gamma voltage VGL0 may be substantially equal to each other. According to an embodiment, the original value of the maximum reference voltage VHI refers to a value of the maximum reference voltage VHI before the maximum reference voltage VHI is changed.

The voltage compensation unit 20*b* includes an amplifier A1 and four resistors R1 to R4. The voltage compensation unit 20*b* receives the maximum reference voltage VHI, the first reference voltage VREG1, and the initial minimum gamma voltage VGL0 and generates a second minimum gamma voltage VGL2.

According to an embodiment, the voltage compensation unit 20*b* is substantially the same as he voltage compensation unit 20*a* of FIG. 3 except that the initial minimum gamma voltage VGL0 is applied to one end of the fourth resistor R4 in the voltage compensation unit 20*b*. Thus, the voltage compensation unit 20*b* outputs the second minimum gamma voltage VGL2 that is equal to the sum of the initial minimum gamma voltage VGL0 and a difference between the maximum reference voltage VHI and the first reference voltage VREG1. Since the first reference voltage VREG1 is substantially equal to the original value of the maximum reference voltage VHI, the difference between the maximum reference voltage VHI and the first reference voltage VREG1 may be substantially equal to a change in the maximum reference voltage VHI. According to an embodiment, the original value of the maximum reference voltage VHI refers to a value of the maximum reference voltage VHI before the maximum reference voltage VHI is changed.

The compensation selection unit 30 may outputs one of the first minimum gamma voltage VGL1 and the second minimum gamma voltage VGL2 as the minimum gamma voltage VGL according to a compensation selection signal CSC. The compensation selection unit 30 may select the first minimum gamma voltage VGL1 as the minimum gamma voltage VGL when reference voltages are set for voltage setting, such as, e.g., when the maximum reference voltage VHI is initially set, or when the maximum reference voltage VHI has the original value, and may select the second minimum gamma voltage VGL2 as the minimum gamma voltage VGL when the maximum reference voltage VHI changes from the original value.

According to an embodiment, when the maximum reference voltage VHI has the original value, the minimum gamma voltage VGL is equal to the initial minimum gamma voltage VGL0. When the maximum reference voltage VHI changes, the second minimum gamma voltage VGL2, e.g., the sum of the initial minimum gamma voltage VGL0 and the change in the maximum reference voltage VHI, is selected as the minimum gamma voltage VGL. Thus, the minimum gamma voltage VGL when the maximum reference voltage VHI changes is subsequently equal to a voltage obtained by changing the minimum gamma voltage VGL, which is generated when the maximum reference voltage VHI has the original value, by the change in the maximum reference voltage VHI. Accordingly, when the maximum reference voltage VHI changes, the maximum gamma voltage VGH and the minimum gamma voltage VGL also change.

Figure 5:
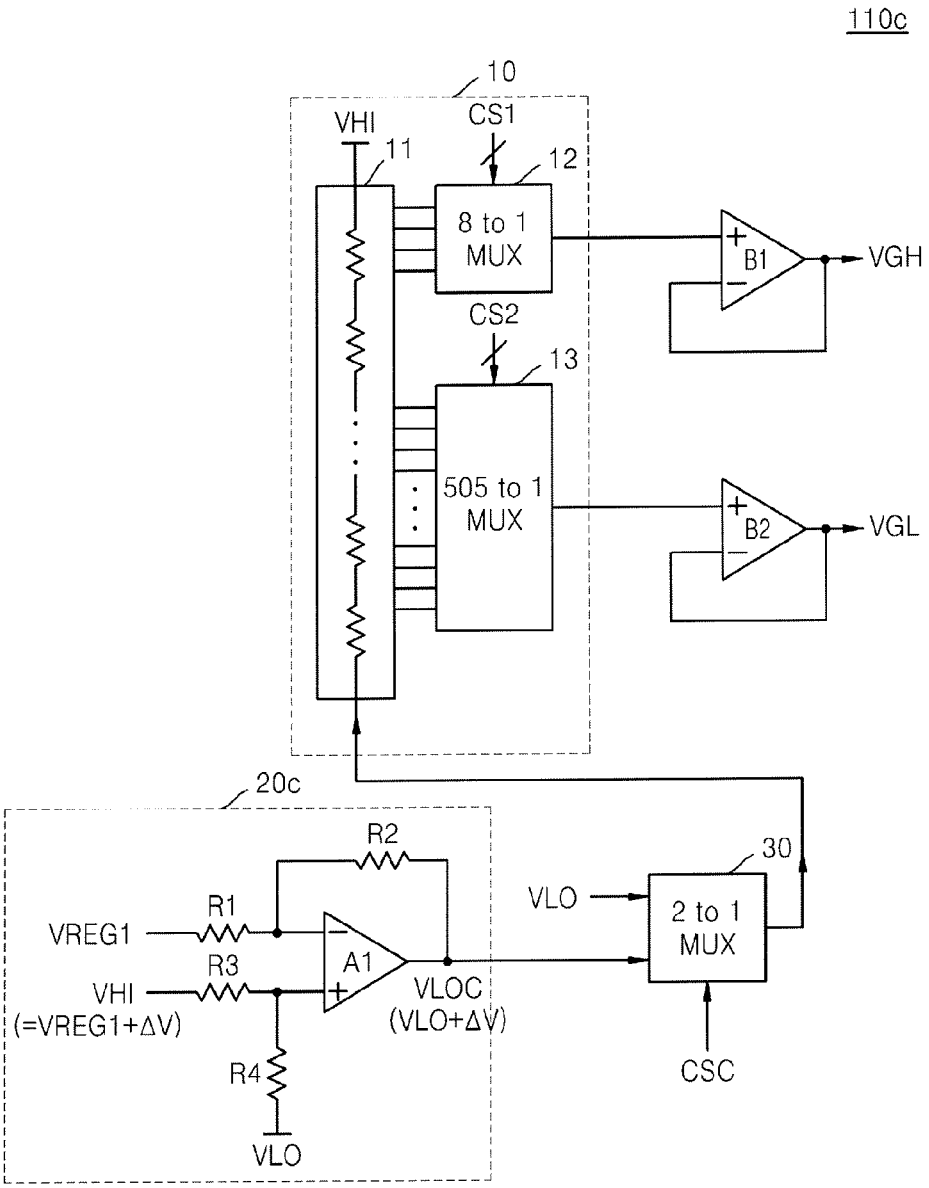
FIG. 5 is a circuit diagram illustrating an example of the reference gamma selector of FIG. 1.

FIG. 5 is a circuit diagram illustrating a reference gamma selector 110*c* that is an example of the reference gamma selector 110 of FIG. 1. Referring to FIG. 5, the reference gamma selector 110*c* includes a maximum-minimum selection unit 10, a voltage compensation unit 20*c*, and a compensation selection unit 30. According to an embodiment, the reference gamma selector 110C may further include buffers B1 and B2 for respectively buffering and outputting a maximum gamma voltage VGH and a minimum gamma voltage VGL.

The voltage compensation unit 20 outputs a compensated minimum reference voltage VLOC that is equal to the sum of a minimum reference voltage VLO and a difference between a maximum reference voltage VHI and a first reference voltage VREG1. The compensation selection unit 30 selects one of the minimum reference voltage VLO and the compensated minimum reference voltage VLOC and applies the selected voltage to the maximum-minimum selection unit 10 according to a compensation selection signal CSC. The maximum-minimum selection unit 10 selects and outputs the maximum gamma voltage VGH and the minimum gamma voltage VGL from among voltages between the maximum reference voltage VHI and the selected voltage applied from the compensation selection unit 30.

The voltage compensation unit 20*c* receives the maximum reference voltage VHI, the first reference voltage VREG1, and the minimum reference voltage VLO and outputs the minimum reference voltage VLOC that is equal to the sum of the minimum reference voltage VLO and the difference between a maximum reference voltage VHI and a first reference voltage VREG1, which is, e.g., a change in the maximum reference voltage VHI. According to an embodiment, the voltage compensation unit 20*c* has the same or substantially the same structure as the voltage compensation unit 20*a* of FIG. 3.

The compensation selection unit 30 selects one of the minimum reference voltage VLO and the compensated minimum reference voltage VLOC according to the compensation selection signal CSC. For example, according to an embodiment, the minimum reference voltage VLO may be selected when the maximum reference voltage VHI has an original value, which is a value of the maxim reference voltage VHI before the maximum reference voltage VHI is changed, and does not change, and the compensated minimum reference voltage VLOC that is equal to a voltage obtained by changing the minimum reference voltage VLO by the change in the maximum reference voltage VHI may be selected when the maximum reference voltage VHI changes by a predetermined level due to a change in a panel driving voltage ELVDD.

The maximum-minimum selection unit 10 generates a plurality of voltages by dividing voltages between the maximum reference voltage VHI and the selected voltage received from the compensation selection unit 30 by using a resistor string 11. The maximum-minimum selection unit 10 selects and outputs the maximum gamma voltage VGH and the minimum gamma voltage VGL from among the plurality of voltages according to a maximum selection signal CSH and a minimum selection signal CSL. According to an embodiment, the maximum-minimum selection unit 10 is the same or similar to the maximum-minimum selection unit 10 of FIG. 3.

Since the minimum reference voltage VLO is selected and applied to the maximum-minimum selection unit 10 before the maximum reference voltage VHI changes, the maximum gamma voltage VGH and the minimum gamma voltage VGL are selected from among voltages between the maximum reference voltage VHI and the minimum reference voltage VLO.

When the maximum reference voltage VHI changes, the changed maximum reference voltage VHI and the compensated minimum reference voltage VLOC that is equal to the sum of the minimum reference voltage VLO and the change in the maximum reference voltage VHI are applied to the maximum-minimum selection unit 10, and the maximum gamma voltage VGH and the minimum gamma voltage VGL are selected from among voltages between the maximum reference voltage VHI and the compensated minimum reference voltage VLOC. When the change in the maximum reference voltage VHI is $\Delta V$, two voltages that are respectively applied to two ends of the maximum resistor string 11 each change by $\Delta V$. Thus, each of the maximum gamma voltage VGH and the minimum gamma voltage VGL is changed by $\Delta V$ and is output.

Figure 6:
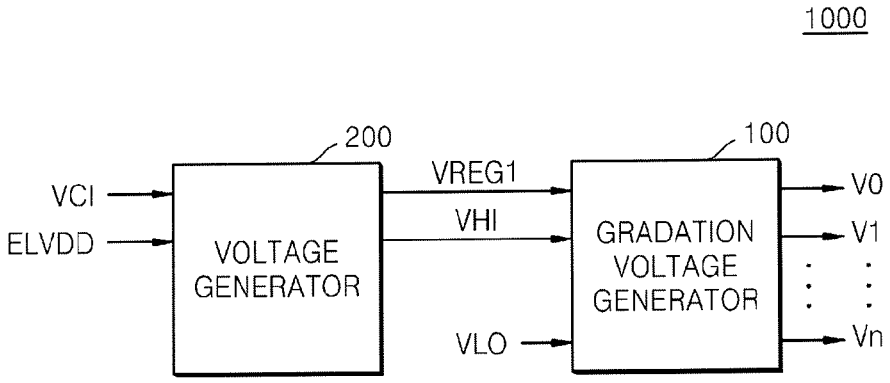
FIG. 6 is a block diagram illustrating a display driving apparatus according to an embodiment of the inventive concept.

FIG. 6 is a block diagram illustrating a display driving apparatus 1000 according to an embodiment of the inventive concept. Referring to FIG. 6, the display driving apparatus 1000 includes a voltage generator 200 and a gradation voltage generator 100.

The voltage generator 200 receives a power supply voltage VCI and a panel driving voltage ELVDD, generates a first reference voltage VREG1 and a maximum reference voltage VHI, and applies the first reference voltage VREG1 and the maximum reference voltage VHI to the gradation voltage generator 100. The first reference voltage VREG1 is constant regardless of a change in the power supply voltage VCI and the panel driving voltage ELVDD. The maximum reference voltage VHI varies according to a change in the driving voltage ELVDD. When voltage setting is performed, such as, e.g., when the maximum reference voltage VHI is initially set, or the driving voltage ELVDD does not change, the maximum reference voltage VHI is equal or substantially equal to the first reference voltage VREG1.

The gradation voltage generator 100 receives the maximum reference voltage VHI, the first reference voltage VREG1, and a minimum reference voltage VLO, and generates and outputs a plurality of gradation voltages V0 to Vn. According to an embodiment, the minimum reference voltage VLO may be a ground voltage.

According to an embodiment, the gradation voltage generator 100 may be the same or substantially the same as the gradation voltage generator 100 of FIG. 1. When the maximum reference voltage VHI changes, the gradation voltage generator 100 selects the maximum gamma voltage VGH of FIG. 1 that changes according to a change in the maximum reference voltage VHI and the minimum gamma voltage VGL of FIG. 1, which is compensated by the change in the maximum reference voltage VHI, and generates a plurality of gradation voltages V0 to Vn from the maximum gamma voltage VGH and the minimum gamma voltage VGL. The plurality of gradation voltages V0 to Vn also change according to a change in the maximum reference voltage VHI. The gradation voltage generator 100 is the same or substantially the same as the gradation voltage generator 100 described above with reference to FIGS. 1 to 5.

Figure 7:
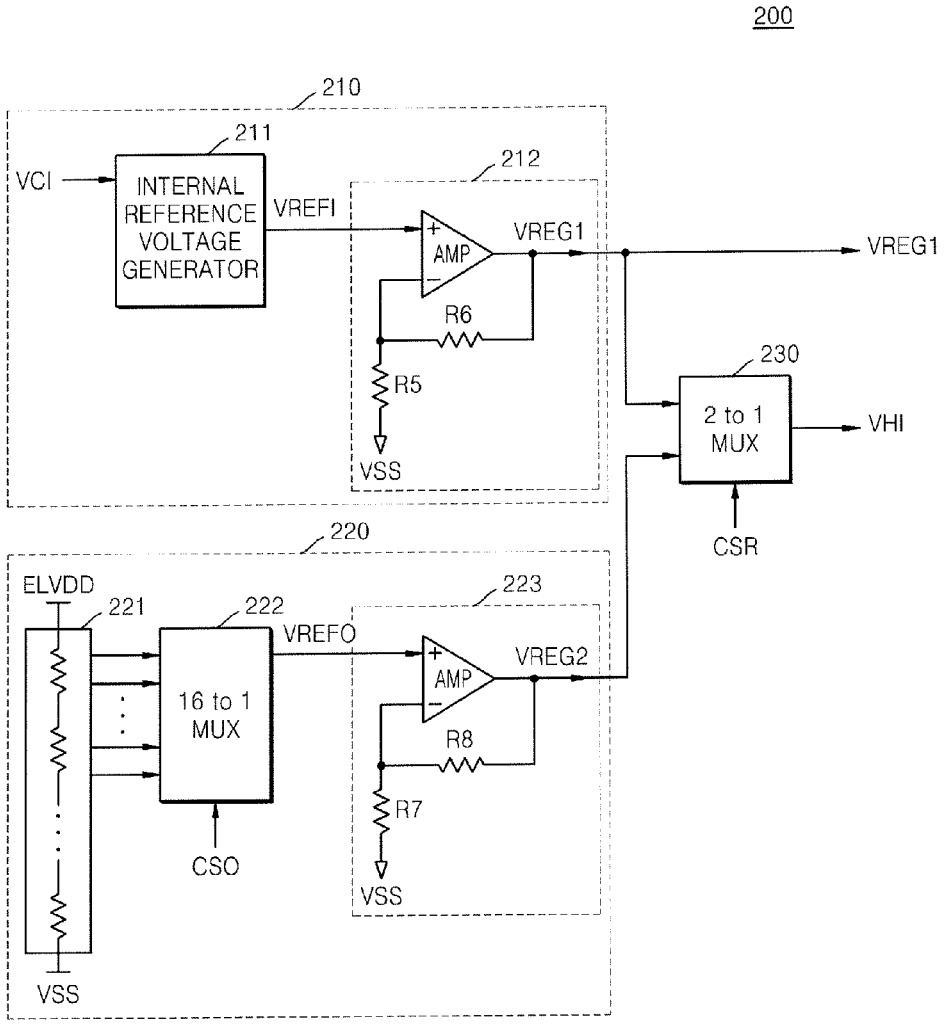
FIG. 7 is a circuit diagram illustrating the voltage generator of FIG. 6, according to an embodiment of the inventive concept.

FIG. 7 is a circuit diagram illustrating the voltage generator 200 of FIG. 6, according to an embodiment of the inventive concept. Referring to FIG. 7, the voltage generator 200 includes a first voltage generator 210, a second voltage generator 220, and a maximum reference voltage selection unit 230.

The first voltage generator 210 generates a first reference voltage VREG1 from a power supply voltage VCI and outputs the first reference voltage VREG1. The first voltage generator 210 may include an internal reference voltage generator 211 and a first amplifier 212.

The internal reference voltage generator 211 generates an internal reference voltage VREFI from the power supply voltage VCI. The first amplifier 212 generates a first reference voltage VREG1 by amplifying the internal reference voltage VREFI. A ratio of the first reference voltage VREG1 to the internal reference voltage VREFI is determined by a ratio between resistance values of resistors R5 and R6. The internal reference voltage VREFI is constant and is not influenced by the power supply voltage VCI or a temperature change. Thus, the first reference voltage VREG1 generated by amplifying the internal reference voltage VREFI is also constant.

The second voltage generator 220 generates a second reference voltage VREG2 from a panel driving voltage ELVDD. The second voltage generator 220 includes a resistor string 221, a selector 222, and a second amplifier 223. A plurality of voltages are generated by dividing the panel driving voltage ELVDD by using the resistor string 221. The selector 222 selects a voltage, e.g., a voltage VREFO, from among the plurality of voltages according to a selection signal CSO. According to an embodiment, the selection signal CSO may be set by an outside source so that the second reference voltage VREG2 may have a predetermined value. The amplifier 223 generates the second reference voltage VREG2 by amplifying the voltage VREFO selected by the selector 222. The ratio of the amplification is determined by the resistors R7 and R8. Since the second reference voltage VREG2 is generated from the panel driving voltage ELVDD, a change in the driving voltage ELVDD results in a change in the second reference voltage VREG2.

The maximum reference voltage selection unit 230 selects and outputs one of the first reference voltage VREG1 and the second reference voltage VREG2 as the maximum reference voltage VHI according to a reference selection signal CSR. The maximum reference voltage selection unit 230 may select the first reference voltage VREG1 as the maximum reference voltage VHI. The maximum reference voltage VHI remains constant regardless of a change in a power supply voltage VCI or the panel driving voltage ELVDD. The first reference voltage VREG1 may be selected as the maximum reference voltage VHI when voltage setting is performed to set initial values of voltages, such as, e.g., the maximum reference voltage VHI, or when the panel driving voltage ELVDD does not change. When the driving voltage ELVDD changes, the second reference voltage VREG2 may be selected as the maximum reference voltage VHI. The maximum reference voltage VHI changes according to the panel driving voltage ELVDD.

Figure 8:
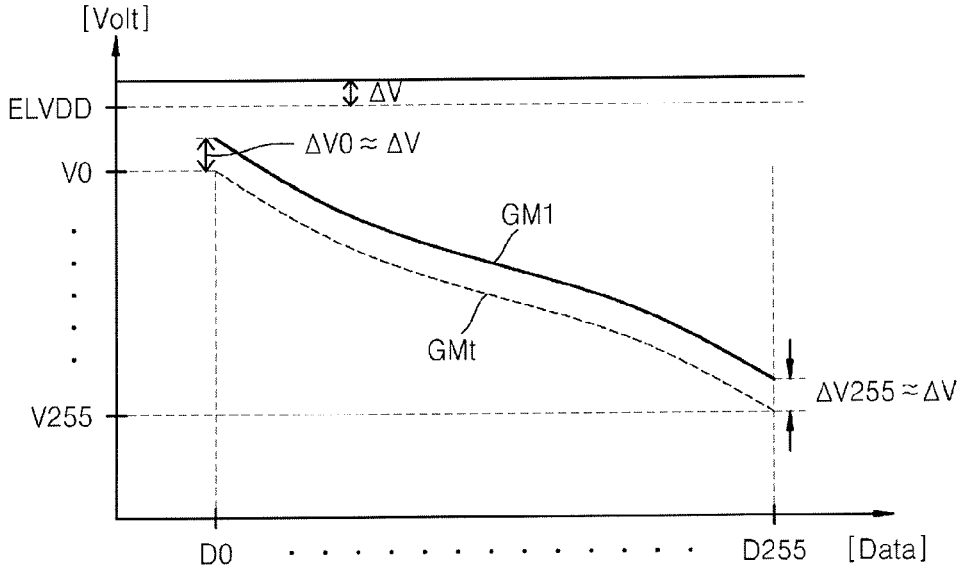
FIG. 8 is a graph illustrating variations in a gradation voltage output from the display driving apparatus of FIG. 6 when a panel driving voltage changes according to an embodiment of the inventive concept.

Then, variations in a gradation voltage and a panel driving voltage ELVDD will now be described with reference to FIG. 8. FIG. 8 is a graph illustrating variations in a gradation voltage output from the display driving apparatus 1000 of FIG. 6 according to an embodiment of the inventive concept. For purposes of description, the display driving apparatus 1000 generates 256 gradation voltages.

Referring to FIG. 8, the relationships between display data D0 to D255 and gradation voltages V0 to V255 may be expressed as gamma curves GMt and GM1. The target gamma curve GMt corresponds to a case where the panel driving voltage ELVDD is equal to a predetermined voltage when voltage setting is performed, such as, e.g., when the maximum reference voltage is initially set. When an offset or ripples occur in the panel driving voltage ELVDD and changes the panel driving voltage ELVDD, the gamma curve changes. When a change in the panel driving voltage ELVDD is ΔV, the gamma curve GM1 shifted by ΔV from the target gamma curve GMt is generated. Changes in the first gradation voltage V0 to the $256^{th}$ gradation voltage V255 approximate ΔV. The brightness of light emitted from a display panel is determined by a difference between the panel driving voltage ELVDD and a gradation voltage. Thus, a change in the panel driving voltage ELVDD may result in a change in the brightness of light. However, in the display driving apparatus 1000 of FIG. 6 according to an embodiment of the inventive concept, even when the driving voltage ELVDD changes, the differences between the panel driving voltage ELVDD and the gradation voltages V0 to V255 are substantially the same as before the driving voltage ELVDD changes. Accordingly, the brightness of light does not change, thereby preventing degradation in image quality.

Figure 9:
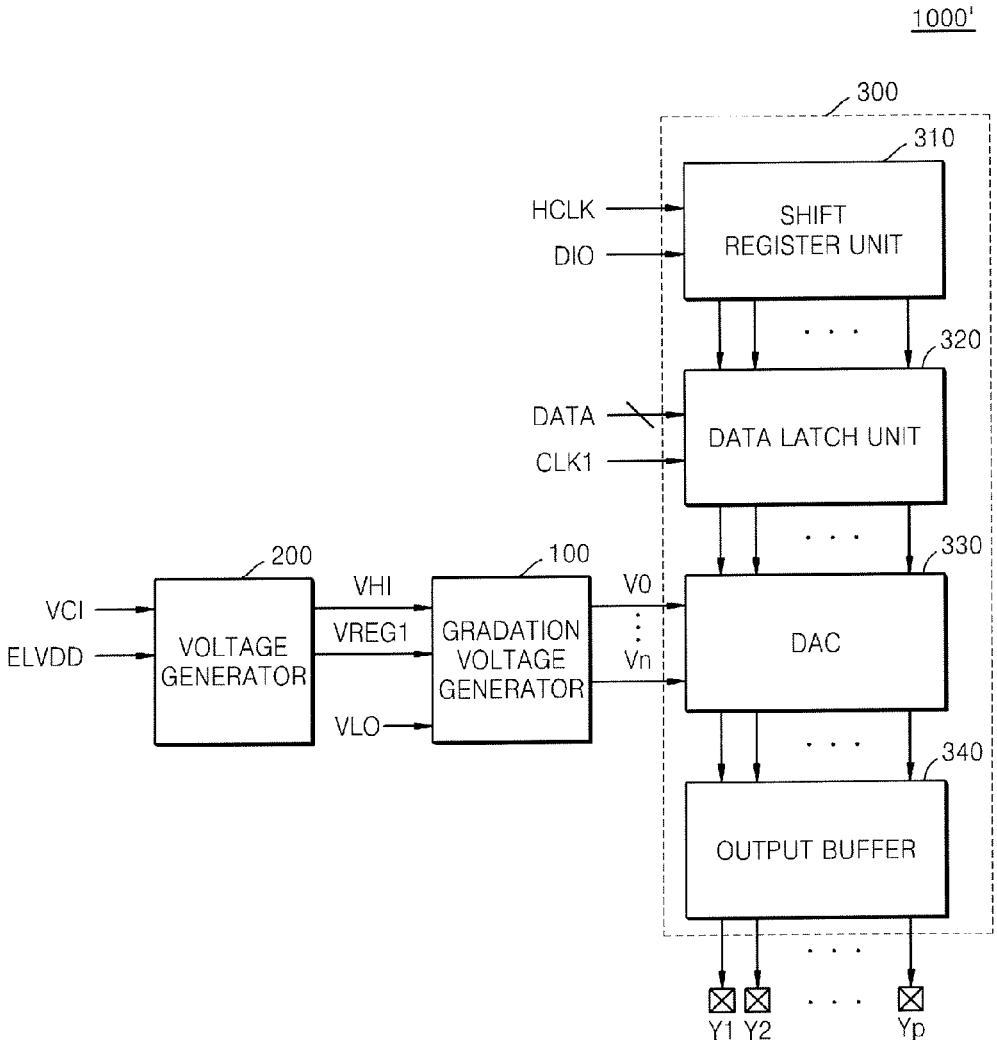
FIG. 9 is a block diagram illustrating a display driving apparatus according to an embodiment of the inventive concept.

FIG. 9 is a block diagram illustrating a display driving apparatus 1000' according to an embodiment of the inventive concept. Referring to FIG. 9, the display driving apparatus 1000' includes a voltage generator 200, a gradation voltage generator 100, and a data driver 300.

The voltage generator 200 generates a first reference voltage VREG1 and a maximum reference voltage VHI by using a power supply voltage VCI and a panel driving voltage ELVDD and applies the first reference voltage VREG1 and the maximum reference voltage VHI to the gradation voltage generator 100. The gradation voltage generator 100 receives the first reference voltage VREG1, the maximum reference voltage VHI, and a minimum reference voltage VLO, generates a plurality of gradation voltages V0 to Vn, and applies the plurality of gradation voltages V0 to Vn to the data driver 300. The voltage generator 200 and the gradation voltage generator 100 are the same or substantially the same as the voltage generator 200 and the gradation voltage generator 100, respectively, described above with reference to FIG. 6.

The data driver 300 includes a shift register unit 310, a data latch unit 320, a digital-to-analog converter (DAC) 330, and an output buffer 340. The data driver 300 receives display data DATA and selects and outputs a gradation voltage corresponding to the digital data DATA from among the plurality of gradation voltages V0 to Vn.

The shift register unit 310 controls a timing when the display data DATA is sequentially stored in the data latch unit 320. The data latch unit 320 receives and stores the display data DATA according to a latch signal DIO that is shifted and output from the shift register unit 310, and outputs the stored display data DATA according to an output control signal CLK1 when pieces of the display data DATA corresponding to one horizontal line is stored.

The DAC 330 receives the display data DATA from the data latch unit 320 and the gradation voltages V0 to Vn from the gradation voltage generator 100, and outputs a gradation voltage corresponding to the data DATA according to the output control signal CLK1. For example, when the display data DATA is m-bit data, the DAC 330, e.g., a gamma decoder, decodes the m-bit display data DATA and selects a gradation voltage from among the $2^m$ gradation voltages V0 to Vn based on a result of the decoding, and applies the selected gradation voltage to the output buffer unit 340.

The output buffer unit 340 buffers and outputs the selected gradation voltage which is an analog gradation signal received from the DAC 330. Source lines of a liquid crystal panel outside the display device 1000' may be connected to the display device 1000' via output pads SOUT_1 to SOUT_P. Thus, analog gradation voltages buffered and output from the output buffer unit 340 are applied to data lines of the liquid crystal panel via the output pads SOUT_1 to SOUT_P, respectively.

Figure 10:
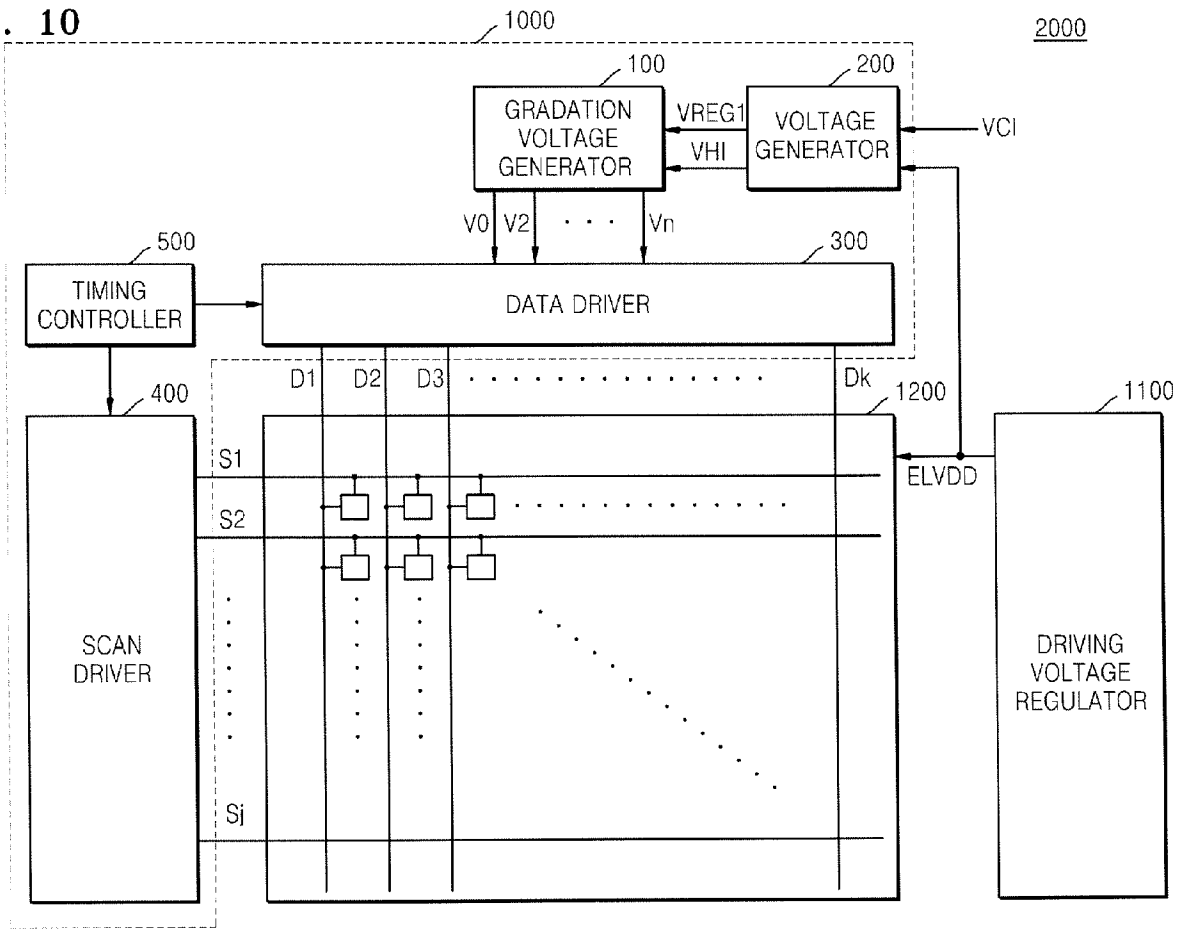
FIG. 10 illustrates a display device according to an embodiment of the inventive concept.

FIG. 10 illustrates a display device 2000 according to an embodiment of the inventive concept. Referring to FIG. 10, the display device 2000 includes a display driving apparatus 1000, a display panel 1200, and a driving voltage regulator 1100.

According to an embodiment, the display device 2000 may be an organic light emitting display device, and the display panel 1200 may be an organic light emitting diode panel. In the display panel 1200, a plurality of pixels are arranged, and each of the pixels includes an organic light emitting diode that emits light according to an amount of current. Each of the pixels may be the same or substantially the same as the pixel illustrated in FIG. 2. In the display panel 1200, j scan lines S1 to Sj are arranged in rows and deliver scan signals, and k data lines D1 to Dk are arranged in columns and deliver data signals.

The driving voltage regulator 1100 generates a panel driving voltage ELVDD and applies the panel driving voltage ELVDD to the display panel 1200 and the display device 1000.

The display driving apparatus 1000 generates a scan signal and a data signal and drive the scan signal and the data signal to the display panel 1200. The display driving apparatus 1000 includes a voltage generator 200, a gradation voltage generator 100, a data driver 300, a scan driver 400, and a timing controller 500. The voltage generator 200, the gradation voltage generator 100, the data driver 300, the scan driver 400, and the timing controller 500 may be mounted on different semiconductor integrated circuits (ICs) or on one semiconductor IC.

The timing controller 500 generates a control signal for controlling the data driver 300 and the scan driver 400, and transmits an image signal received from an outside source to the data driver 300. The timing controller 500 may include a graphic random access memory (GRAM) and may store an image signal received from an outside source in the GRAM and may transmit the image signal to the data driver 300. The GRAM may store display data corresponding to one frame and may sequentially transmit a plurality of pieces of display data corresponding to a horizontal line to be displayed to the data driver 300.

The voltage generator 200 receives a power supply voltage VCI and a panel driving voltage ELVDD, generates a first reference voltage VREG1 and a maximum reference voltage VHI, and applies the first reference voltage VREG1 and the maximum reference voltage VHI to the gradation voltage generator 100. The gradation voltage generator 100 generates a plurality of gradation voltage V0 to Vn and applies the plurality of gradation voltage V0 to Vn to the data driver 300.

The data driver 300 selects gradation voltages corresponding to the display data DATA from among the plurality of gradation voltages V0 to Vn and applies the selected gradation voltages to the data lines D1 to Dk of the display panel 1200 according to the control signal received from the timing controller 500.

The scan driver 400 is connected to the scan lines S1 to Sj of the display panel 300 and sequentially delivers scan signals to corresponding pixels of the display panel 300. Data signals, e.g., the selected gradation voltages, which are output from the data driver 300 are applied to the pixels to which the scan signals are applied.

The panel driving voltage ELVDD may have a deviation according to the characteristics of the driving voltage regulator 1100 or ripples may occur in the panel driving voltage ELVDD when the display panel 1200 is driven. Thus, the panel driving voltage ELVDD may change. However, according to an embodiment, the gradation voltages V0 to Vn vary according to the change in the panel driving voltage ELVDD, thereby preventing image quality from being degraded due to a change in the driving voltage ELVDD.

According to an embodiment, the embodiments of the inventive concept may also be applied to at least one of various types of flat panel display devices that are driven in a manner similar to a manner in which an organic light emitting display apparatus is driven, such as a Liquid Crystal Display (LCD), an ElectroChromic Display (ECD), a Digital Mirror Device (DMD), an Actuated Mirror Device (AMD), a Grating Light Value (GLV), a Plasma Display Panel (PDP), an Electro Luminescent Display (ELD), a Light Emitting Diode (LED) display, and a Vacuum Fluorescent Display (VFD).

Figure 11:
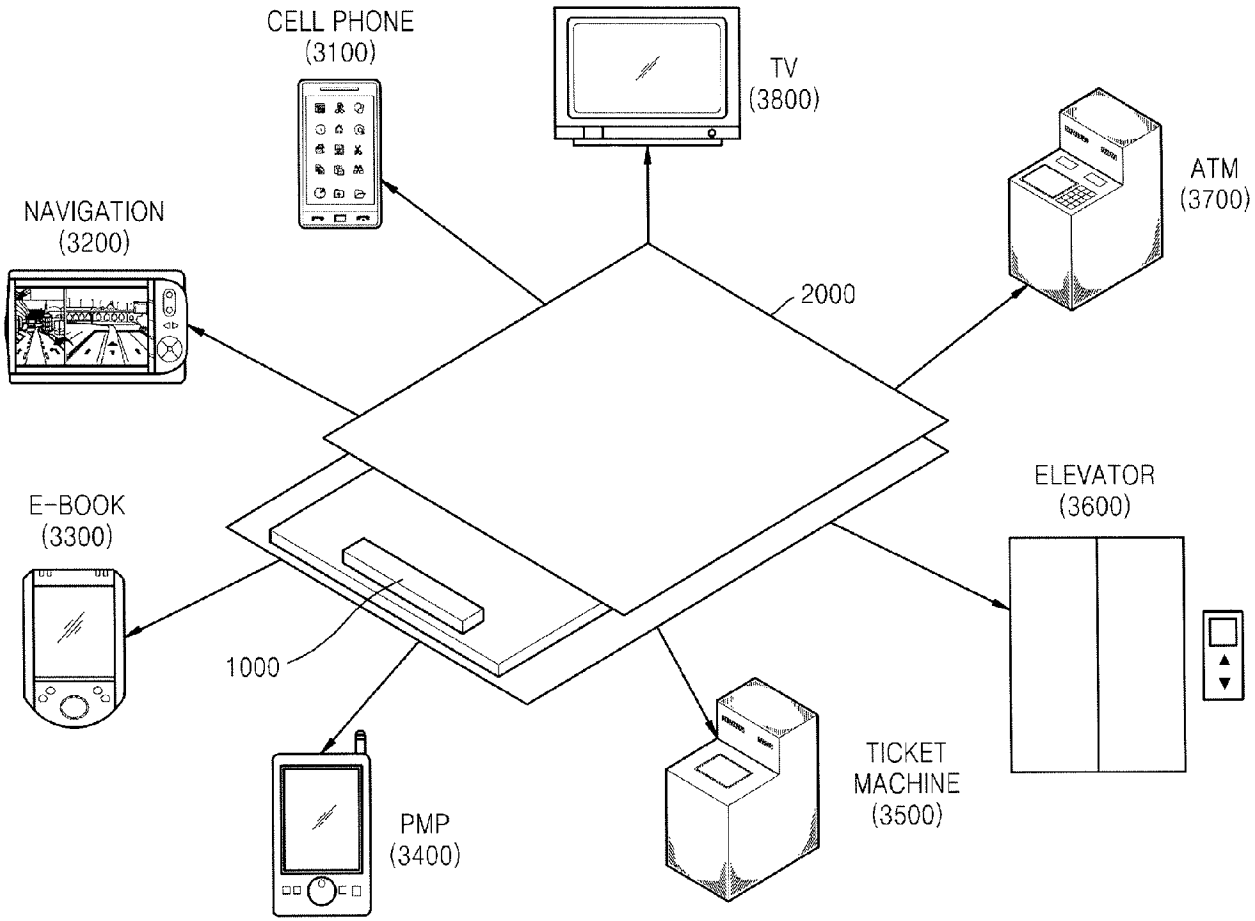
FIG. 11 illustrates various exemplary electronics which include a display device according to an embodiment of the inventive concept.

FIG. 11 illustrates various exemplary electronics which include a display device 2000 according to an embodiment of the inventive concept. The display device 2000 may have various applications including a cellular phone 3100, a navigation 3200, e-book 3300, a portable multimedia player (PMP) 3400, a ticket machine 3500 installed in, for example, a subway station, an elevator 3600, an automated teller machine (ATM) 3700, or a large-scale television (TV) 3800. According to an embodiment, the display device 2000 may be used in various electronic apparatuses in the field of display. The display device 2000 according to an embodiment of the inventive concept may provide a high-quality image by preventing image quality from being degraded regardless of a change in a driving voltage ELVDD.

In the present disclosure, the embodiments of the inventive concept have been shown and described. The specific terms used in the present disclosure are not intended to restrict the scope of the present invention and only used for a better understanding of the present invention. Thus, it would be appreciated by those of ordinary skill in the art that changes may be made in these exemplary embodiments without departing from the principles and spirit of the invention.

What is claimed is:

1. A gradation voltage generator comprising:

a first unit configured to generate a first gamma voltage and a second gamma voltage lower than the first gamma voltage from a first voltage and a second voltage lower than the first voltage, wherein the first voltage is generated based on a panel driving voltage, and wherein the first voltage is closer to the first gamma voltage than to the second gamma voltage;

a second unit configured, if the first voltage is changed, to generate a third gamma voltage by compensating the second gamma voltage based on a change in the first voltage; and a third unit configured to output a plurality of gradation voltages from the first gamma voltage and the second gamma voltage or from the first gamma voltage and the third gamma voltage to a display panel.

2. The gradation voltage generator of claim 1, further comprising a multiplexer configured to select one of the second gamma voltage and the third gamma voltage in response to a compensation selection signal.

3. The gradation voltage generator of claim 2, wherein the compensation selection signal is set depending on a change in the panel driving voltage.

4. The gradation voltage generator of claim 3, wherein if the change in the panel driving voltage is equal to or greater than a predetermined value, the multiplexer is configured to select the third gamma voltage.

5. The gradation voltage generator of claim 4, wherein the third gamma voltage is the same or substantially the same as a sum of the second gamma voltage and the change in the first voltage due to the change in the panel driving voltage.

6. The gradation voltage generator of claim 1, wherein the first unit selects the first gamma voltage corresponding to a maximum selection signal and the second gamma voltage corresponding to a minimum selection signal from among voltages between the first voltage and the second voltage.

7. The gradation voltage generator of claim 6, wherein the second unit receives a first reference voltage.

8. The gradation voltage generator of claim 7, wherein the change of the first voltage is substantially equal to a difference between the first reference voltage and the first voltage.

9. The gradation voltage generator of claim 8, wherein the second unit comprises:

an amplifier having a first input terminal, a second input terminal, and an output terminal, wherein the amplifier outputs the third gamma voltage via the output terminal;

a first resistor having one end to which the first reference voltage is applied and another end connected to the first input terminal of the amplifier;

a second resistor having one end connected to the first input terminal of the amplifier and another end connected to the output terminal of the amplifier;

a third resistor having one end to which the first reference voltage is applied and another end connected to the second input terminal of the amplifier; and a fourth resistor having one end to which the second gamma voltage is applied and another end connected to the second input terminal of the amplifier.

10. A gradation voltage generator comprising:

a first unit configured to generate a first gamma voltage and a second gamma voltage lower than the first gamma voltage from a first voltage and a second voltage lower than the first voltage or from the first voltage and a third voltage lower than the first voltage, wherein the first voltage is generated based on a panel driving voltage, and wherein the first voltage is closer to the first gamma voltage than to the second gamma voltage;

a second unit configured, if the first voltage is changed, to generate the third voltage by compensating the second voltage based on a change in the first voltage; and a third unit configured to output a plurality of gradation voltages from the first gamma voltage and the second gamma voltage to a display panel.

11. The gradation voltage generator of claim 10, further comprising:

a multiplexer selecting one of the second voltage and the third voltage according to a compensation selection signal and outputting the one of the second voltage and the third voltage to the first unit.

12. The gradation voltage generator of claim 11, wherein the first unit is configured to select the first gamma voltage corresponding to a maximum selection signal and the second gamma voltage corresponding to a minimum selection signal from among voltages between the first gamma voltage and the second gamma voltage.

13. The gradation voltage generator of claim 10, wherein the second unit receives a first reference voltage and generates the third voltage by compensating the second voltage for a difference between the first reference voltage and the first gamma voltage.

14. The gradation voltage generator of claim 11, wherein if a change in the panel driving voltage is equal to or greater than a predetermined value, the compensation selection signal is set to select the third voltage.

15. The gradation voltage generator of claim 10, wherein the third voltage is the same or substantially the same as a sum of the second voltage and the change in the first voltage due to a change in the panel driving voltage.

16. A method of generating a plurality of gradation voltages, comprising:

receiving a panel driving voltage;

receiving a first voltage, a second voltage and a reference voltage and generating a first gamma voltage and a second gamma voltage based on the first voltage and the second voltage;

generating a third gamma voltage by adding a voltage difference between the first voltage and the reference voltage to the second gamma voltage;

selecting one of the second gamma voltage and the third gamma voltage according to a change in the panel driving voltage; and generating a plurality of gradation voltages based on the first gamma voltage and the one of the second gamma voltage and the third gamma voltage.

17. The method of claim 16, wherein if a change in the panel driving voltage is equal to or greater than a predetermined value, the third gamma voltage is selected in the selecting of one of the second gamma voltage and the third gamma voltage.

18. The method of claim 16, wherein a voltage level of the reference voltage is between a voltage level of the first voltage and a voltage level of the second voltage and wherein the voltage level of the reference voltage is closer to the voltage level of the first voltage.

* * * * *